US011585610B2

(12) United States Patent
Yanik et al.

(10) Patent No.: US 11,585,610 B2
(45) Date of Patent: Feb. 21, 2023

(54) HEAT EXCHANGER AND AIR-CONDITIONING SYSTEM

(71) Applicant: Danfoss Micro Channel Heat Exchanger (Jiaxing) Co., Ltd., Zhejiang (CN)

(72) Inventors: Mustafa K Yanik, Zhejiang (CN); John D Kennedy, Zhejiang (CN)

(73) Assignee: Danfoss Micro Channel Heat Exchanger (Jiaxing) Co., Ltd., Zhejiang (CN)

( * ) Notice: Subject to any disclaimer, the term of this patent is extended or adjusted under 35 U.S.C. 154(b) by 56 days.

(21) Appl. No.: 17/125,346

(22) Filed: Dec. 17, 2020

(65) Prior Publication Data

US 2021/0102759 A1 Apr. 8, 2021

Related U.S. Application Data

(62) Division of application No. 16/079,783, filed as application No. PCT/CN2016/112060 on Dec. 26, 2016, now abandoned.

(30) Foreign Application Priority Data

Mar. 21, 2016 (CN) ..... 201610161048.X

(51) Int. Cl.
*F28F 1/12* (2006.01)
*F25B 39/02* (2006.01)
(Continued)

(52) U.S. Cl.
CPC ..... *F28F 1/122* (2013.01); *F25B 39/02* (2013.01); *F28D 1/05308* (2013.01);
(Continued)

(58) Field of Classification Search
CPC .. F28D 1/05358; F28D 1/0461; F28D 1/0452; F28D 1/0443; F28D 1/0408;
(Continued)

(56) References Cited

U.S. PATENT DOCUMENTS 6,408,939 B1 * 6/2002 Sugimoto ..... F28F 1/128 165/149
6,595,272 B1 * 7/2003 Uchikawa ..... F28F 9/002 29/890.03
(Continued)

*Primary Examiner* — Tho V Duong
(74) *Attorney, Agent, or Firm* — McCormick, Paulding & Huber PLLC

(57) ABSTRACT

A heat exchanger (100) and an air-conditioning system. The heat exchanger (100) comprises: a group of first heat exchange tubes (T1) for forming a first loop (C1); a group of second heat exchange tubes (T2) for forming a second loop (C2); and a group of fins (3), at least a plurality of fins (3) in the group of fins (3) being in contact with both at least a plurality of first heat exchange tubes (1) in the group of first heat exchange tubes (T1), and at least a plurality of second heat exchange tubes (T2) in the group of second heat exchange tubes (T2). If one loop of an air-conditioning system having two loops is closed, heat exchange regions of the fins for the loop can be used in the other loop, thereby improving the heat exchange efficiency of a heat exchanger.

6 Claims, 12 Drawing Sheets

(51) Int. Cl.

| | |
|---|---|
| ***F28D 7/00*** | (2006.01) |
| ***F28D 1/053*** | (2006.01) |
| ***F28F 1/24*** | (2006.01) |
| ***F28F 1/32*** | (2006.01) |
| ***F28F 1/02*** | (2006.01) |

(52) U.S. Cl.
CPC ..... *F28D 7/0066* (2013.01); *F28F 1/022* (2013.01); *F28F 1/126* (2013.01); *F28F 1/128* (2013.01); *F28F 1/24* (2013.01); *F28F 1/32* (2013.01); *F28F 1/325* (2013.01); *F28D 1/05391* (2013.01)

(58) Field of Classification Search
CPC ..... F28D 1/05391; F28F 1/325; F28F 1/32; F28F 1/24; F28F 1/28; F28F 1/128; F28F 1/022; F28F 1/126; F25B 39/02
See application file for complete search history.

(56) References Cited

U.S. PATENT DOCUMENTS

| | | | | |
|---|---|---|---|---|
| 2001/0040021 | A1* | 11/2001 | Avequin ..... | F28F 9/0131 29/890.03 |
| 2003/0066633 | A1* | 4/2003 | Lee ..... | F28D 1/05391 165/175 |
| 2006/0249277 | A1* | 11/2006 | Riondet ..... | F28F 9/001 29/890.03 |
| 2009/0301696 | A1* | 12/2009 | Iwasaki ..... | F28D 1/0435 165/140 |
| 2016/0003547 | A1* | 1/2016 | Okazawa ..... | F28F 1/32 165/172 |

* cited by examiner

HEAT EXCHANGER AND AIR-CONDITIONING SYSTEM

CROSS-REFERENCE TO RELATED APPLICATIONS

This application is a divisional of U.S. patent application Ser. No. 16/079,783, filed Aug. 24, 2018, which is a National Stage application of International Patent Application No. PCT/CN2016/112060, filed on Dec. 26, 2016, which claims priority to Chinese Patent Application No. 201610161048.X, filed on Mar. 21, 2016, each of which is hereby incorporated by reference in its entirety.

TECHNICAL FIELD

The embodiments of the present invention relate to a heat exchanger and an air-conditioning system.

BACKGROUND

In a conventional air-conditioning system, the heat exchangers of two circuits are separate.

SUMMARY

The object of the embodiments of the present invention is to provide a heat exchanger and an air-conditioning system, whereby, for example, if one circuit of a dual-circuit air-conditioning system is shut off, a heat exchange region of fins used for that circuit can be used for the other circuit, thereby increasing the heat exchange efficiency of the heat exchanger.

An embodiment of the present invention provides a heat exchanger, comprising: a set of first heat exchange tubes for forming a first circuit; a set of second heat exchange tubes for forming a second circuit; and a set of fins, with at least multiple fins in the set of fins being in contact with at least multiple first heat exchange tubes in the set of first heat exchange tubes and at least multiple second heat exchange tubes in the set of second heat exchange tubes simultaneously.

According to an embodiment of the present invention, the at least multiple first heat exchange tubes in the set of first heat exchange tubes, the at least multiple second heat exchange tubes in the set of second heat exchange tubes and the at least multiple fins in the set of fins are arranged in an arrangement direction such that: the at least multiple first heat exchange tubes are respectively arranged at Mth positions, M=2n−1; the at least multiple second heat exchange tubes are respectively arranged at Mth positions, M=2n−1; and the at least multiple fins are respectively arranged at Nth positions, N=2n, where n is a positive integer; each of the at least multiple fins in the set of fins has a first part and a second part; at the Mth positions, the first heat exchange tubes are juxtaposed with the second heat exchange tubes, with the first parts of the at least multiple fins in the set of fins being in contact with the at least multiple first heat exchange tubes in the set of first heat exchange tubes, and the second parts of the at least multiple fins in the set of fins being in contact with the at least multiple second heat exchange tubes in the set of second heat exchange tubes.

According to an embodiment of the present invention, the at least multiple first heat exchange tubes in the set of first heat exchange tubes, the at least multiple second heat exchange tubes in the set of second heat exchange tubes and the at least multiple fins in the set of fins are arranged in an arrangement direction such that: the at least multiple first heat exchange tubes are respectively arranged at (M1)th positions, M1=4n−3; the at least multiple second heat exchange tubes are respectively arranged at (M2)th positions, M2=4n−1; and the at least multiple fins are respectively arranged at Nth positions, N=2n, where n is a positive integer.

According to an embodiment of the present invention, each of the at least multiple fins in the set of fins has a first part and a second part, with the first parts of the at least multiple fins in the set of fins being in contact with the at least multiple first heat exchange tubes in the set of first heat exchange tubes, and the second parts of the at least multiple fins in the set of fins being in contact with the at least multiple second heat exchange tubes in the set of second heat exchange tubes.

According to an embodiment of the present invention, the heat exchanger further comprises: a first supporting part connected to at least one of the at least multiple first heat exchange tubes, the first supporting part being located between the second parts of adjacent fins amongst the at least multiple fins, and being used to support the second parts of the adjacent fins amongst the at least multiple fins.

According to an embodiment of the present invention, the heat exchanger further comprises: a second supporting part connected to at least one of the at least multiple second heat exchange tubes, the second supporting part being located between the first parts of adjacent fins amongst the at least multiple fins, and being used to support the first parts of the adjacent fins amongst the at least multiple fins.

According to an embodiment of the present invention, the at least one of the at least multiple first heat exchange tubes has substantially the same thickness as the first supporting part.

According to an embodiment of the present invention, the at least one of the at least multiple second heat exchange tubes has substantially the same thickness as the second supporting part.

According to an embodiment of the present invention, each of the at least multiple fins in the set of fins has a first part and a second part; the at least multiple first heat exchange tubes in the set of first heat exchange tubes have first heat exchange tube first parts in contact with the first parts and first heat exchange tube second parts in contact with the second parts, and the at least multiple second heat exchange tubes in the set of second heat exchange tubes have second heat exchange tube first parts in contact with the first parts and second heat exchange tube second parts in contact with the second parts.

According to an embodiment of the present invention, when viewed in the arrangement direction, the at least multiple first heat exchange tubes in the set of first heat exchange tubes and the at least multiple second heat exchange tubes in the set of second heat exchange tubes cross over each other.

According to an embodiment of the present invention, at least partial regions of the at least multiple first heat exchange tubes in the set of first heat exchange tubes are disposed obliquely relative to a length direction of the at least multiple fins in the set of fins, and at least partial regions of the at least multiple second heat exchange tubes in the set of second heat exchange tubes are disposed obliquely relative to the length direction of the at least multiple fins in the set of fins.

According to an embodiment of the present invention, the at least multiple first heat exchange tubes in the set of first heat exchange tubes and the at least multiple second heat exchange tubes in the set of second heat exchange tubes are straight tubes.

According to an embodiment of the present invention, the at least multiple first heat exchange tubes in the set of first heat exchange tubes also have first heat exchange tube third parts, which are located between the first heat exchange tube first parts and the first heat exchange tube second parts and connect the first heat exchange tube first parts to the first heat exchange tube second parts, and the at least multiple second heat exchange tubes in the set of second heat exchange tubes also have second heat exchange tube third parts, which are located between the second heat exchange tube first parts and the second heat exchange tube second parts and connect the second heat exchange tube first parts to the second heat exchange tube second parts.

According to an embodiment of the present invention, the first heat exchange tube first parts and the first heat exchange tube second parts extend substantially in a length direction of the fins, and the second heat exchange tube first parts and the second heat exchange tube second parts extend substantially in the length direction of the fins.

According to an embodiment of the present invention, the first part and the second part of each of the at least multiple fins in the set of fins, when viewed in the arrangement direction, are disposed substantially symmetrically relative to a center line extending in a length direction of the fin.

According to an embodiment of the present invention, ends of the at least multiple second heat exchange tubes in the set of second heat exchange tubes project from the set of fins in a thickness direction of the heat exchanger.

According to an embodiment of the present invention, the at least multiple first heat exchange tubes in the set of first heat exchange tubes, middle parts between two ends of the at least multiple second heat exchange tubes in the set of second heat exchange tubes, and the at least multiple fins in the set of fins are arranged in a row in the arrangement direction.

According to an embodiment of the present invention, the set of fins is arranged in a row.

According to an embodiment of the present invention, the set of fins is arranged in a row, the set of first heat exchange tubes is arranged in a row, and the set of second heat exchange tubes is arranged in a row.

An embodiment of the present invention provides an air-conditioning system, comprising the heat exchanger described above.

With the heat exchanger according to an embodiment of the present invention, for example, if one circuit of a dual-circuit air-conditioning system is shut off, a heat exchange region of fins used for that circuit can be used for the other circuit, thereby increasing the heat exchange efficiency of the heat exchanger.

DETAILED DESCRIPTION

An air-conditioning system according to an embodiment of the present invention comprises a heat exchanger. Specifically, the air-conditioning system according to an embodiment of the present invention comprises a compressor, a heat exchanger serving as an evaporator, a heat exchanger serving as a condenser, and an expansion valve, etc. The air-conditioning system comprises two circuits.

Referring to FIGS. 1 to 26, the heat exchanger 100 according to embodiments of the present invention comprises: a set of first heat exchange tubes T1 for forming a first circuit C1; a set of second heat exchange tubes T2 for forming a second circuit C2; and a set of fins 3, with at least multiple fins 3 in the set of fins 3 being in contact with at least multiple first heat exchange tubes T1 in the set of first heat exchange tubes T1 and at least multiple second heat exchange tubes T2 in the set of second heat exchange tubes T2 simultaneously. The first circuit C1 and the second circuit C2 are different circuits. The heat exchanger 100 further comprises: first headers M1 connected to a set of first heat exchange tubes T1, and second headers M2 connected to a set of second heat exchange tubes T2; the first headers M1 are respectively formed with an inlet C11 and an outlet C12 of the first circuit, and the second headers M1 are respectively formed with an inlet C21 and an outlet C22 of the second circuit. The heat exchange tubes may be flat tubes. Each fin 3 may be an integral whole. The first circuit C1 and the second circuit C2 may be independent of each other, connected in parallel.

Figure 2:
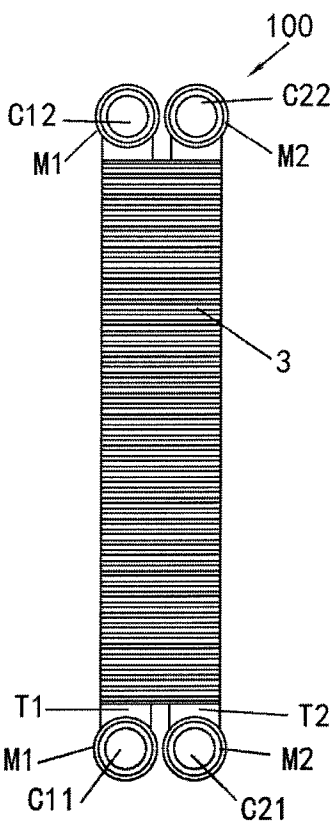
FIG. 2 is a schematic side view of the heat exchanger according to the first embodiment of the present invention.
Figure 1:
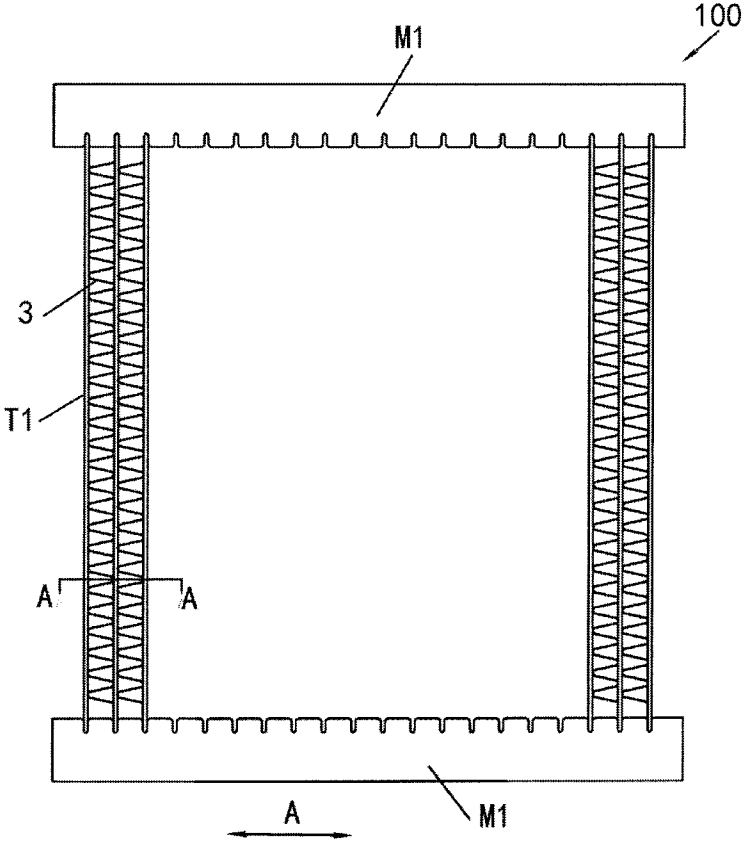
FIG. 1 is a schematic main view of a heat exchanger according to a first embodiment of the present invention.
Figure 3:
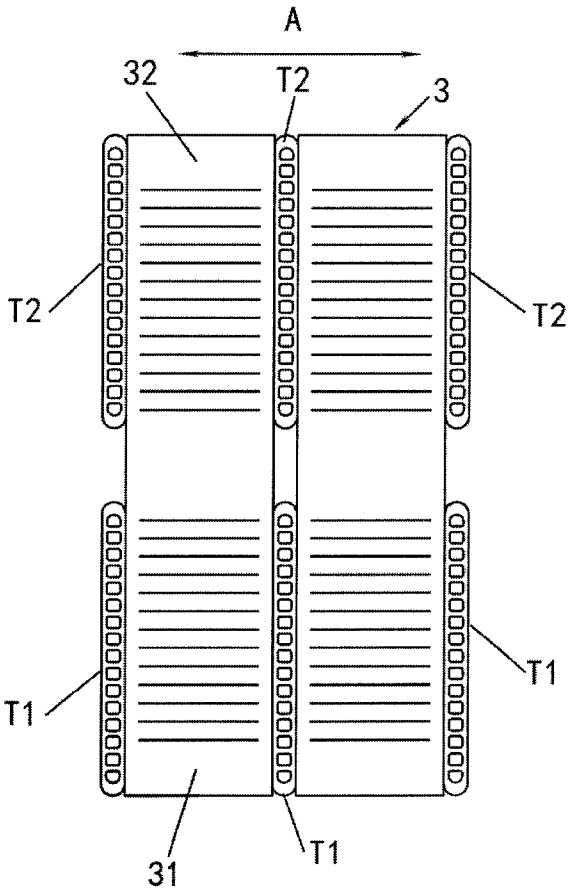
FIG. 3 is a partial sectional view along line AA in FIG. 1 of the heat exchanger according to the first embodiment of the present invention.
Figure 5:
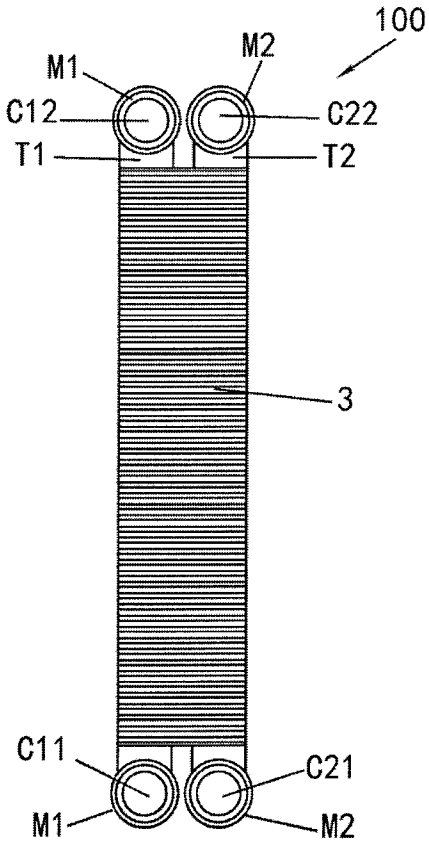
FIG. 5 is a schematic side view of the heat exchanger according to the second embodiment of the present invention.
Figure 4:
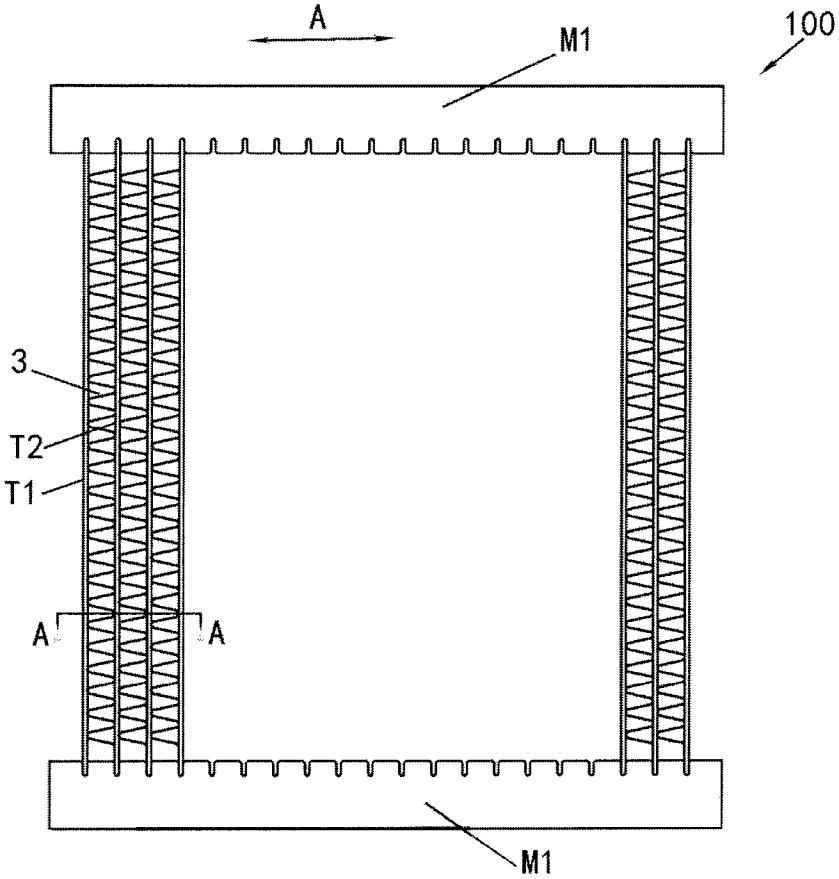
FIG. 4 is a schematic main view of a heat exchanger according to a second embodiment of the present invention.
Figure 6:
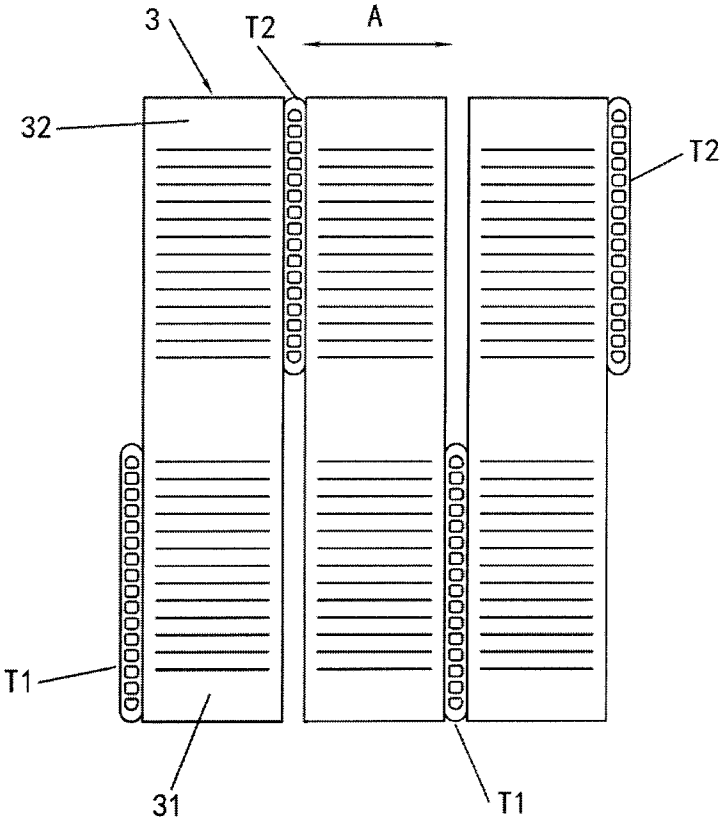
FIG. 6 is a partial sectional view along line AA in FIG. 4 of the heat exchanger according to the second embodiment of the present invention.

Referring to FIGS. 1 to 3, in some embodiments of the present invention, the at least multiple first heat exchange tubes T1 in the set of first heat exchange tubes T1, the at least multiple second heat exchange tubes T2 in the set of second heat exchange tubes T2 and the at least multiple fins 3 in the set of fins 3 are arranged in an arrangement direction A such that: the at least multiple first heat exchange tubes T1 are respectively arranged at Mth positions, M=2n−1; the at least multiple second heat exchange tubes T2 are respectively arranged at Mth positions, M=2n−1; and the at least multiple fins 3 are respectively arranged at Nth positions, N=2n, where n is a positive integer. Each of the at least multiple fins 3 in the set of fins 3 has a first part 31 and a second part 32; at the Mth positions, the first heat exchange tubes T1 are juxtaposed with the second heat exchange tubes T2, with the first parts 31 of the at least multiple fins 3 in the set of fins 3 being in contact with the at least multiple first heat exchange tubes T1 in the set of first heat exchange tubes T1, and the second parts 32 of the at least multiple fins 3 in the set of fins 3 being in contact with the at least multiple second heat exchange tubes T2 in the set of second heat exchange tubes T2. In this embodiment, the first heat exchange tubes T1 and the second heat exchange tubes T2 share the fins 3; the width of each fin 3 is the sum of the width of the first heat exchange tube T1, the width of the second heat exchange tube T2 and a gap between the first part 31 and the second part 32. According to an example of the present invention, the first part 31 and the second part 32 of each of the at least multiple fins 3 in the set of fins 3, when viewed in the arrangement direction A, are disposed side by side in a width direction of the fin 3 (the left-right direction in FIGS. 1 and 2), and furthermore may be disposed substantially symmetrically relative to a center line extending in a length direction of the fin 3 (the up-down direction in FIGS. 1 and 2).

Referring to FIGS. 4 to 20, in some embodiments of the present invention, the at least multiple first heat exchange tubes T1 in the set of first heat exchange tubes T1, the at least multiple second heat exchange tubes T2 in the set of second heat exchange tubes T2 and the at least multiple fins 3 in the set of fins 3 are arranged in an arrangement direction A; the at least multiple first heat exchange tubes T1 are respectively arranged at (M1)th positions, M1=4n−3; the at least multiple second heat exchange tubes T2 are respectively arranged at (M2)th positions, M2=4n−1; and the at least multiple fins 3 are respectively arranged at Nth positions, N=2n, where n is a positive integer. In this embodiment, the first heat exchange tubes T1 and the second heat exchange tubes T2 share the fins 3.

Referring to FIGS. 4 to 9, in some embodiments of the present invention, each of the at least multiple fins 3 in the set of fins 3 has a first part 31 and a second part 32, with the first parts 31 of the at least multiple fins 3 in the set of fins 3 being in contact with the at least multiple first heat exchange tubes T1 in the set of first heat exchange tubes T1, and the second parts 32 of the at least multiple fins 3 in the set of fins 3 being in contact with the at least multiple second heat exchange tubes T2 in the set of second heat exchange tubes T2. In this embodiment, the first heat exchange tubes T1 and the second heat exchange tubes T2 share the fins 3; the width of each fin 3 is the sum of the width of the first heat exchange tube T1, the width of the second heat exchange tube T2 and a gap between the first part 31 and the second part 32. According to an example of the present invention, the first part 31 and the second part 32 of each of the at least multiple fins 3 in the set of fins 3, when viewed in the arrangement direction A, are disposed side by side in the width direction of the fin 3 (the left-right direction in FIGS. 1 and 2), and furthermore may be disposed substantially symmetrically relative to a center line extending in the length direction of the fin 3 (the up-down direction in FIGS. 4 and 5). In the embodiment shown in FIGS. 4 to 6, fewer heat exchange tubes may be used, and air that is blown to the first heat exchange tubes T1 and the second heat exchange tubes T2, and to those parts of the fins 3 which are in contact with the first heat exchange tubes T1 and the second heat exchange tubes T2, has substantially the same temperature, so that the the two circuits have more similar performance.

Figure 8:
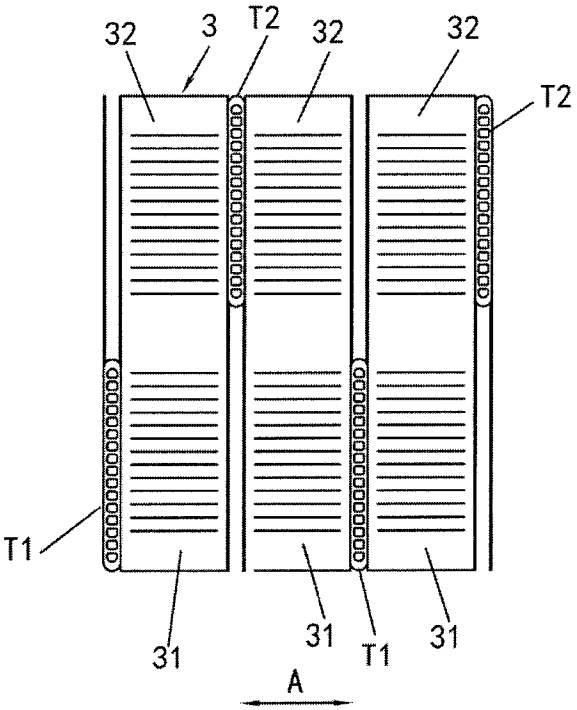
FIG. 8 is a schematic top view of an improved heat exchange tube of the heat exchanger according to the second embodiment of the present invention.
Figure 9:
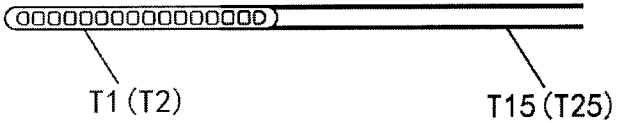
FIG. 9 is a partial sectional view along line AA in FIG. 4 of the heat exchanger according to the second embodiment of the present invention, in the case where improved heat exchange tubes are used.
Figure 7:
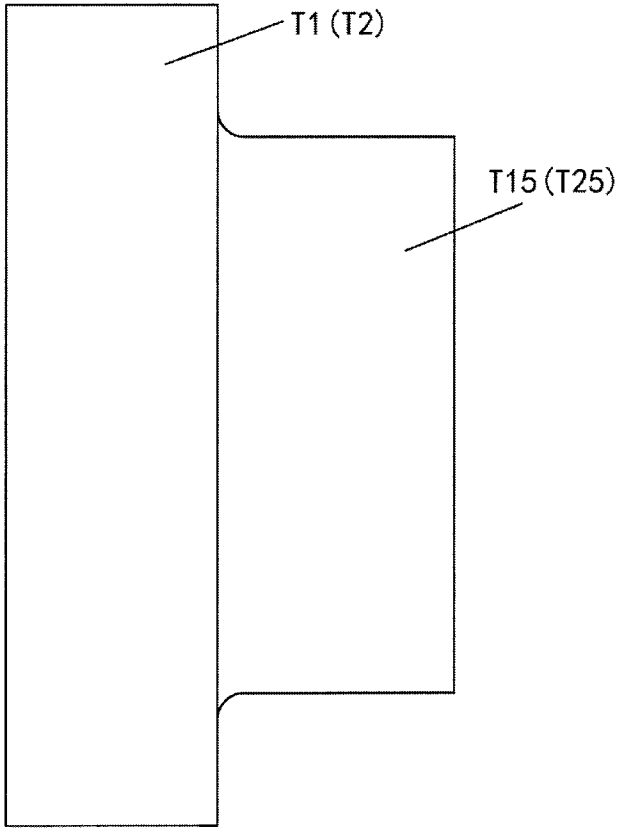
FIG. 7 is a schematic main view of an improved heat exchange tube of the heat exchanger according to the second embodiment of the present invention.
Figure 11:
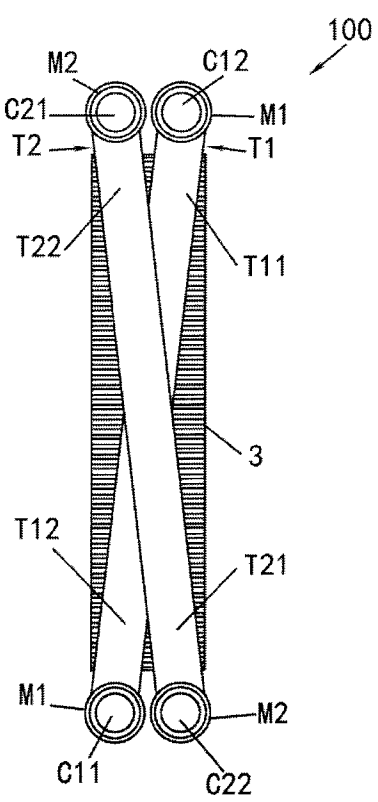
FIG. 11 is a schematic side view of the heat exchanger according to the third embodiment of the present invention.
Figure 10:
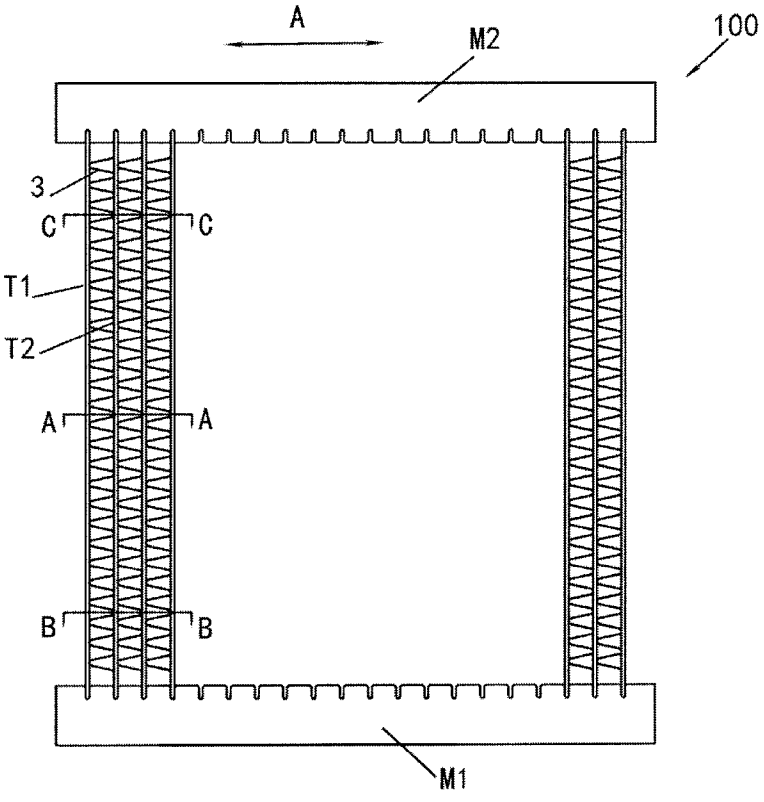
FIG. 10 is a schematic main view of a heat exchanger according to a third embodiment of the present invention.
Figure 14:
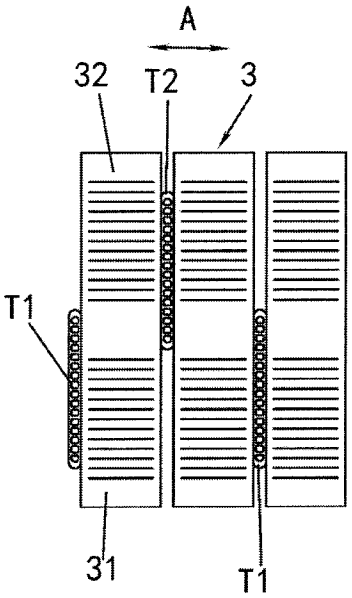
FIG. 14 is a partial sectional view along line CC in FIG. 10 of the heat exchanger according to the third embodiment of the present invention.
Figure 13:
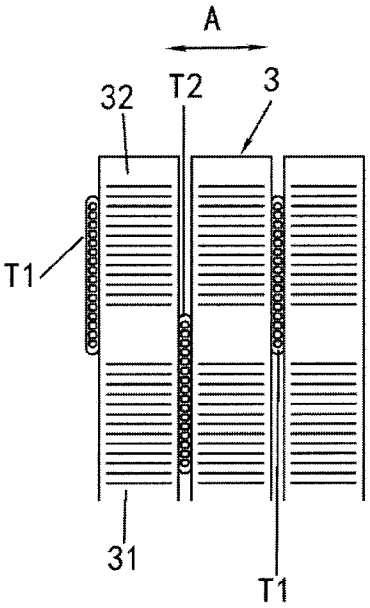
FIG. 13 is a partial sectional view along line BB in FIG. 10 of the heat exchanger according to the third embodiment of the present invention.
Figure 12:
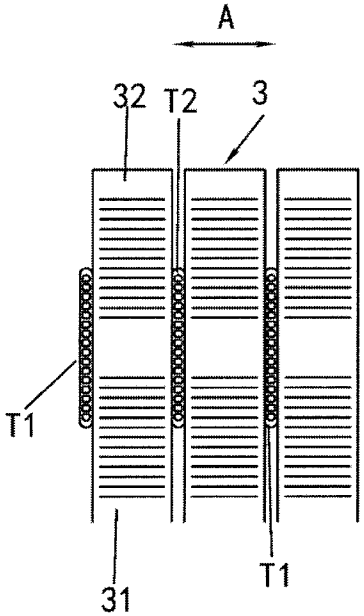
FIG. 12 is a partial sectional view along line AA in FIG. 10 of the heat exchanger according to the third embodiment of the present invention.
Figure 16:
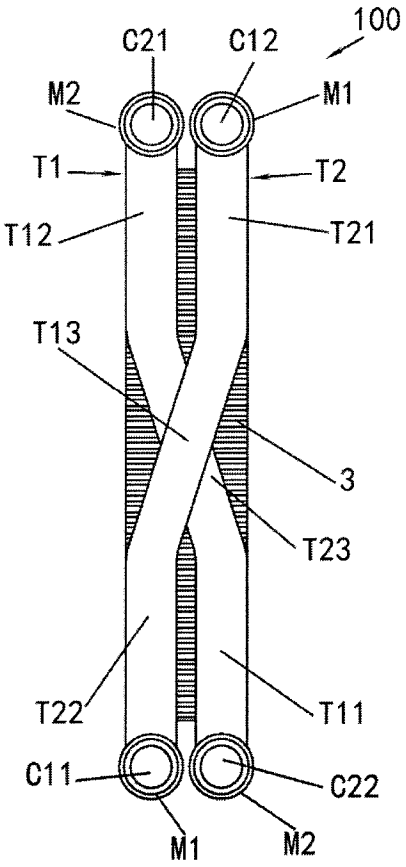
FIG. 16 is a schematic side view of the heat exchanger according to the fourth embodiment of the present invention.
Figure 15:
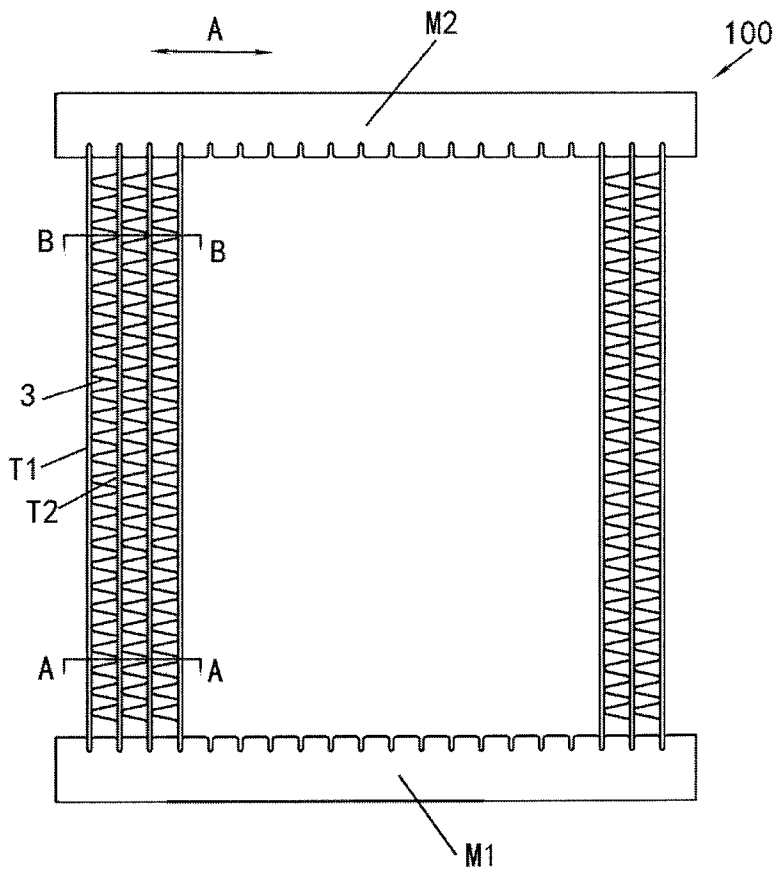
FIG. 15 is a schematic main view of a heat exchanger according to a fourth embodiment of the present invention.
Figure 18:
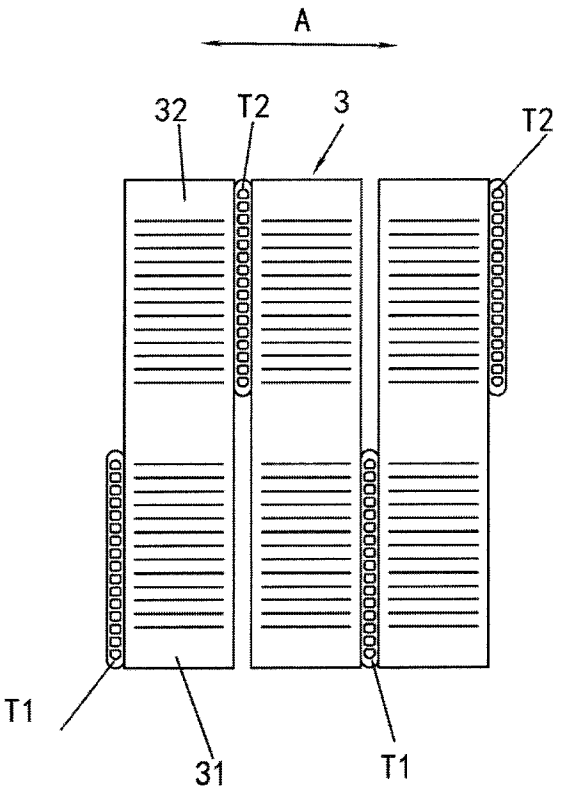
FIG. 18 is a partial sectional view along line BB in FIG. 15 of the heat exchanger according to the fourth embodiment of the present invention.
Figure 17:
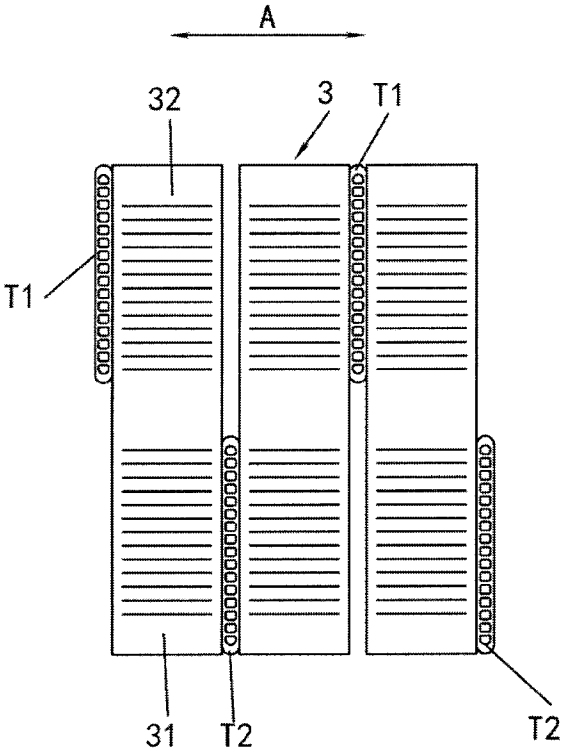
FIG. 17 is a partial sectional view along line AA in FIG. 15 of the heat exchanger according to the fourth embodiment of the present invention.
Figure 20:
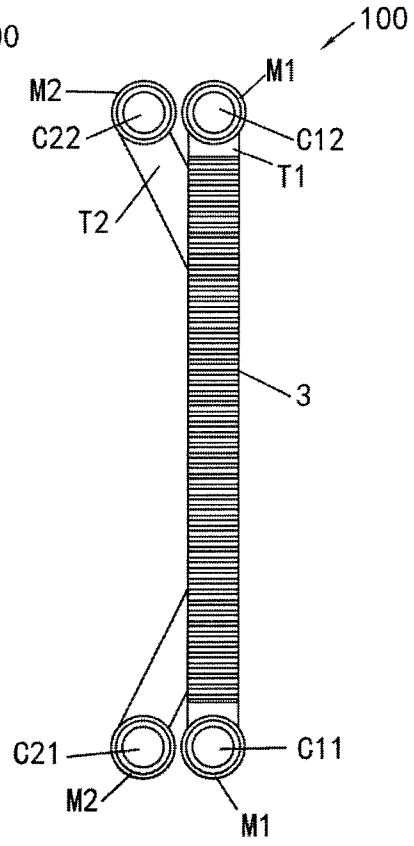
FIG. 20 is a schematic side view of the heat exchanger according to the fifth embodiment of the present invention.
Figure 19:
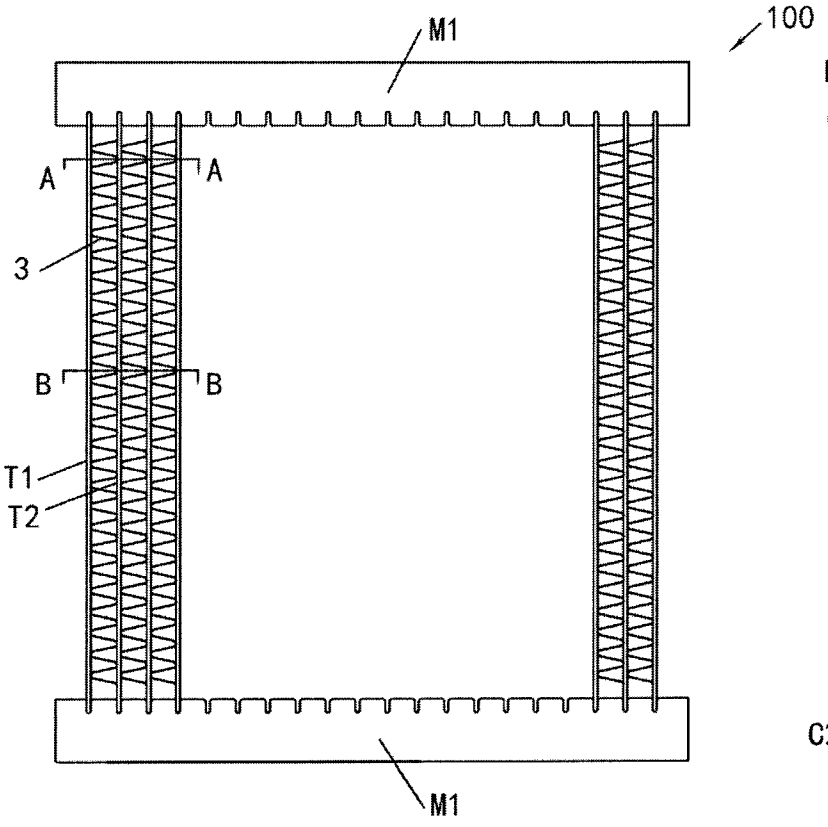
FIG. 19 is a schematic main view of a heat exchanger according to a fifth embodiment of the present invention.
Figure 22:
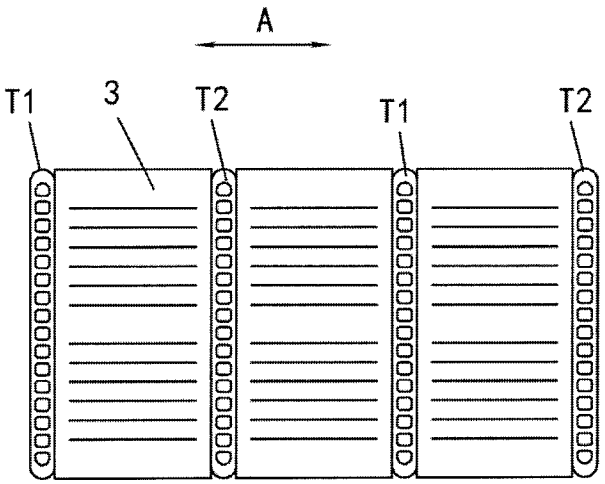
FIG. 22 is a partial sectional view along line BB in FIG. 19 of the heat exchanger according to the fifth embodiment of the present invention.
Figure 21:
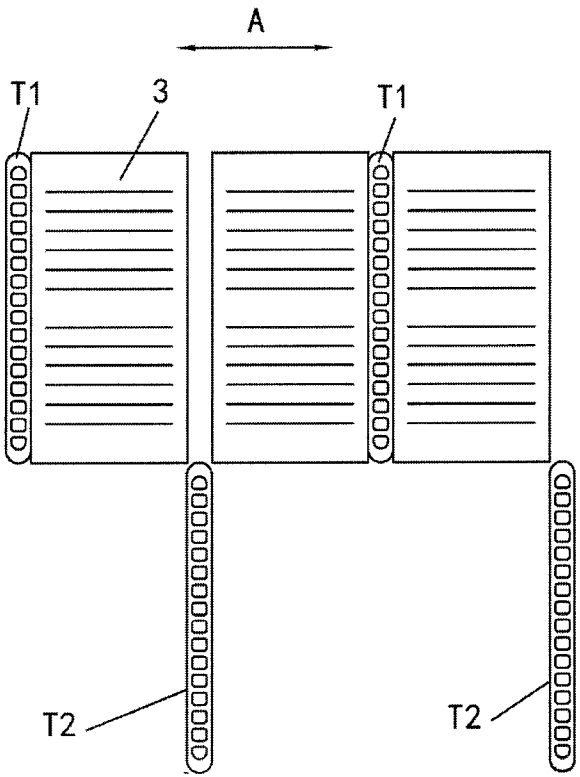
FIG. 21 is a partial sectional view along line AA in FIG. 19 of the heat exchanger according to the fifth embodiment of the present invention.

Referring to FIGS. 7 to 9, in some embodiments of the present invention, the heat exchanger 100 further comprises: a first supporting part T15 connected to at least one of the at least multiple first heat exchange tubes T1, the first supporting part T15 being located between the second parts 32 of adjacent fins 3 amongst the at least multiple fins 3, and being used to support the second parts 32 of the adjacent fins 3 amongst the at least multiple fins 3. The heat exchanger 100 may further comprise: a second supporting part T25 connected to at least one of the at least multiple second heat exchange tubes T2, the second supporting part T25 being located between the first parts 31 of adjacent fins 3 amongst the at least multiple fins 3, and being used to support the first parts 31 of the adjacent fins 3 amongst the at least multiple fins 3. The at least one of the at least multiple first heat exchange tubes T1 may have substantially the same thickness as the first supporting part T15. The at least one of the at least multiple second heat exchange tubes T2 may have substantially the same thickness as the second supporting part T25. As shown in FIG. 7, the first supporting part T15 may be connected to a central part in a length direction of the first heat exchange tube T1, and be of a shorter length than the first heat exchange tube T1 so that the connection of the ends of the first heat exchange tube T1 to the headers M1 is not affected; similarly, the second supporting part T25 may be connected to a central part in a length direction of the second heat exchange tube T2, and be of a shorter length than the second heat exchange tube T2 so that the connection of the ends of the second heat exchange tube T2 to the headers M2 is not affected. The use of the first supporting part T15 and the second supporting part T25 enables the first parts 31 and the second parts 32 of the fins 3 to be supported, and facilitates the conduction of heat from the first heat exchange tube T1 and the second heat exchange tube T2 to the fins 3.

Referring to FIGS. 10 to 18, in some embodiments of the present invention, each of the at least multiple fins 3 in the set of fins 3 has a first part 31 and a second part 32; the at least multiple first heat exchange tubes T1 in the set of first heat exchange tubes T1 have first heat exchange tube first parts T11 in contact with the first parts 31 and first heat exchange tube second parts T12 in contact with the second parts 32, and the at least multiple second heat exchange tubes T2 in the set of second heat exchange tubes T2 have second heat exchange tube first parts T21 in contact with the first parts 31 and second heat exchange tube second parts T22 in contact with the second parts 32. According to an example of the present invention, when viewed in the arrangement direction A, the at least multiple first heat exchange tubes T1 in the set of first heat exchange tubes T1 and the at least multiple second heat exchange tubes T2 in the set of second heat exchange tubes T2 cross over each other. According to an example of the present invention, the first part 31 and the second part 32 of each of the at least multiple fins 3 in the set of fins 3, when viewed in the arrangement direction A, are disposed side by side in the width direction of the fin 3 (the left-right direction in FIGS. 1 and 2), and furthermore may be disposed substantially symmetrically relative to a center line extending in the length direction of the fin 3 (the up-down direction in FIGS. 10 and 11).

Referring to FIGS. 10 to 14, in some embodiments of the present invention, the at least multiple first heat exchange tubes T1 or at least partial regions of the at least multiple first heat exchange tubes T1 in the set of first heat exchange tubes T1 are disposed obliquely relative to the length direction of the at least multiple fins 3 in the set of fins 3, and the at least multiple second heat exchange tubes T2 or at least partial regions of the at least multiple second heat exchange tubes T2 in the set of second heat exchange tubes T2 are disposed obliquely relative to the length direction of the at least multiple fins 3 in the set of fins 3. In other words, in a plane defined by a thickness direction of the heat exchanger 100 and the length direction of the fins 3, the at least multiple first heat exchange tubes T1 or at least partial regions of the at least multiple first heat exchange tubes T1 in the set of first heat exchange tubes T1 are disposed obliquely relative to the length direction of the at least multiple fins 3 in the set of fins 3, and the at least multiple second heat exchange tubes T2 or at least partial regions of the at least multiple second heat exchange tubes T2 in the set of second heat exchange tubes T2 are disposed obliquely relative to the length direction of the at least multiple fins 3 in the set of fins 3. According to an example of the present invention, the at least multiple first heat exchange tubes T1 in the set of first heat exchange tubes T1 and the at least multiple second heat exchange tubes T2 in the set of second heat exchange tubes T2 may be straight tubes. In this embodiment, the first heat exchange tubes T1 and the second heat exchange tubes T2 share the fins 3; the width of each fin 3 is the sum of the width of the first heat exchange tube T1, the width of the second heat exchange tube T2 and a gap between the first part 31 and the second part 32. According to an example of the present invention, the first part 31 and the second part 32 of each of the at least multiple fins 3 in the set of fins 3, when viewed in the arrangement direction A, are disposed side by side in a width direction of the fin 3 (the left-right direction in FIGS. 1 and 2), and furthermore may be disposed substantially symmetrically relative to a center line extending in a length direction of the fin 3 (the up-down direction in FIGS. 10 and 11). In this embodiment, the outlets of the two circuits may be located on a windward side, whereby the two circuits are arranged such that a flow direction of a heat exchange medium in the heat exchanger is opposite to a flow direction of air, thereby facilitating heat exchange.

Referring to FIGS. 15 to 18, in some embodiments of the present invention, the at least multiple first heat exchange tubes T1 in the set of first heat exchange tubes T1 also have first heat exchange tube third parts T13, which are located between the first heat exchange tube first parts T11 and the first heat exchange tube second parts T12 and connect the first heat exchange tube first parts T11 to the first heat exchange tube second parts T12, and the at least multiple second heat exchange tubes T2 in the set of second heat exchange tubes T2 also have second heat exchange tube third parts T23, which are located between the second heat exchange tube first parts T21 and the second heat exchange tube second parts T22 and connect the second heat exchange tube first parts T21 to the second heat exchange tube second parts T22. According to an example of the present invention, the first heat exchange tube first parts T11 and the first heat exchange tube second parts T12 extend substantially in the length direction of the fins 3, and the second heat exchange tube first parts T21 and the second heat exchange tube second parts T22 extend substantially in the length direction of the fins 3. In this embodiment, the first heat exchange tubes T1 and the second heat exchange tubes T2 share the fins 3; the width of each fin 3 is the sum of the width of the first heat exchange tube T1, the width of the second heat exchange tube T2 and a gap between the first part 31 and the second part 32. According to an example of the present invention, the first part 31 and the second part 32 of each of the at least multiple fins 3 in the set of fins 3, when viewed in the arrangement direction A, are disposed side by side in the width direction of the fin 3 (the left-right direction in FIGS. 1 and 2), and furthermore may be disposed substantially symmetrically relative to a center line extending in the length direction of the fin 3 (the up-down direction in FIGS. 15 and 16). In this embodiment, the first heat exchange tubes T1 and the second heat exchange tubes T2 are straight tubes, and central parts in the length direction thereof have bent parts. Thus, the heat exchanger according to this embodiment is easier to manufacture.

Referring to FIGS. 19 to 22, in some embodiments of the present invention, ends of the at least multiple second heat exchange tubes T2 in the set of second heat exchange tubes T2 project from the set of fins 3 in the thickness direction of the heat exchanger 100. The at least multiple first heat exchange tubes T1 in the set of first heat exchange tubes T1, middle parts between two ends of the at least multiple second heat exchange tubes T2 in the set of second heat exchange tubes T2, and the at least multiple fins 3 in the set of fins 3 are arranged in a row in the arrangement direction A. In this embodiment, the first heat exchange tubes T1 and the second heat exchange tubes T2 share the fins 3; the width of the fins 3 is approximately equal to the width of the first heat exchange tubes T1 and the width of the second heat exchange tubes T2. In this embodiment, the first heat exchange tubes T1 are straight tubes. Except for the ends of the second heat exchange tubes T2, the second heat exchange tubes T2 are straight tubes, with the ends of the second heat exchange tubes T2 being bent and protruding outside a core body of the heat exchanger, so that the second heat exchange tubes T2 can be connected to the corresponding headers M2. The ends of the second heat exchange tubes T2 are not in contact with the fins 3.

According to embodiments of the present invention, as shown in FIGS. 1 to 26, the set of fins 3 is arranged in a row. According to an example of the present invention, the set of fins 3 is arranged in a row, the set of first heat exchange tubes T1 is arranged in a row, and the set of second heat exchange tubes T2 is arranged in a row.

Figure 26:
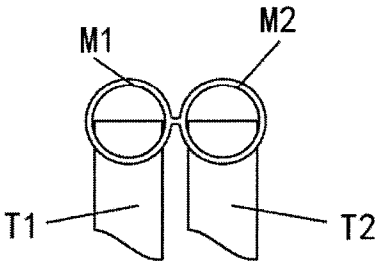
FIG. 26 is a schematic diagram of a header of a heat exchanger according to another embodiment of the present invention.
Figure 25:
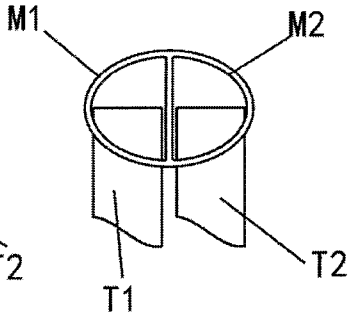
FIG. 25 is a schematic diagram of a header of a heat exchanger according to another embodiment of the present invention.
Figure 24:
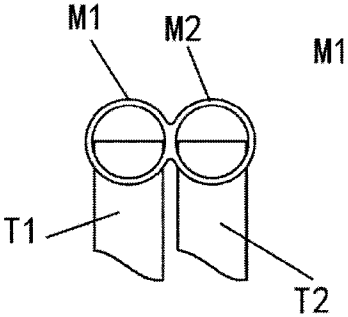
FIG. 24 is a schematic diagram of a header of a heat exchanger according to another embodiment of the present invention.
Figure 23:
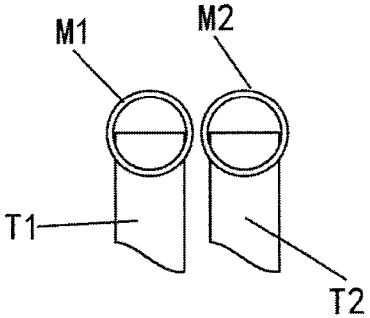
FIG. 23 is a schematic diagram of a header of a heat exchanger according to an embodiment of the present invention.

As shown in FIGS. 23 to 26, any suitable structure may be employed for the headers M1 and M2. For instance, a structure in which the headers are separate as shown in FIG. 23; a structure in which the headers are connected to each other as shown in FIGS. 24 and 26; and a structure in which the headers are formed using a single tube by means of a partition plate as shown in FIG. 25.

According to an embodiment of the present invention, since the first heat exchange tubes T1 and the second heat exchange tubes T2 share the fins 3, if one circuit of a dual-circuit air-conditioning system is closed, then a heat exchange region of the fins used for that circuit can be used for the other circuit, thereby increasing the heat exchange efficiency of the heat exchanger.

In addition, the above embodiments according to the present invention may be combined to form new embodiments.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A heat exchanger, comprising:

a set of first heat exchange tubes for forming a first circuit;

a set of second heat exchange tubes for forming a second circuit; and a set of fins, with at least multiple fins in the set of fins being in contact with at least multiple first heat exchange tubes in the set of first heat exchange tubes and at least multiple second heat exchange tubes in the set of second heat exchange tubes simultaneously, wherein ends of the at least multiple second heat exchange tubes in the set of second heat exchange tubes project from the set of fins in a thickness direction of the heat exchanger; and wherein the at least multiple first heat exchange tubes in the set of first heat exchange tubes, middle parts between two ends of the at least multiple second heat exchange tubes in the set of second heat exchange tubes, and the at least multiple fins in the set of fins are arranged in a same row in the arrangement direction.

2. The heat exchanger as claimed in claim 1, wherein:

the at least multiple first heat exchange tubes in the set of first heat exchange tubes, the at least multiple second heat exchange tubes in the set of second heat exchange tubes and the at least multiple fins in the set of fins are arranged in an arrangement direction such that:

the at least multiple first heat exchange tubes are respectively arranged at (M1)th positions, M1=4n−3;

the at least multiple second heat exchange tubes are respectively arranged at (M2)th positions, M2=4n−1; and the at least multiple fins are respectively arranged at Nth positions, N=2n, where n is a positive integer.

3. An air-conditioning system, comprising:

the heat exchanger as claimed in claim 1.

4. The air-conditioning system as claimed in claim 3, wherein:

the at least multiple first heat exchange tubes in the set of first heat exchange tubes, the at least multiple second heat exchange tubes in the set of second heat exchange tubes and the at least multiple fins in the set of fins are arranged in an arrangement direction such that:

the at least multiple first heat exchange tubes are respectively arranged at (M1)th positions, M1=4n−3;

the at least multiple second heat exchange tubes are respectively arranged at (M2)th positions, M2=4n−1; and the at least multiple fins are respectively arranged at Nth positions, N=2n, where n is a positive integer.

5. A dual circuit air-conditioning system, comprising:

a heat exchanger comprising:

a set of first heat exchange tubes for forming a first circuit of the dual circuit air-conditioning system;

a set of second heat exchange tubes for forming a second circuit of the dual circuit air-conditioning system, the second circuit being different than the first circuit; and a set of fins, with at least multiple fins in the set of fins being in contact with at least multiple first heat exchange tubes in the set of first heat exchange tubes and at least multiple second heat exchange tubes in the set of second heat exchange tubes simultaneously, wherein ends of the at least multiple second heat exchange tubes in the set of second heat exchange tubes project from the set of fins in a thickness direction of the heat exchanger; and wherein the at least multiple first heat exchange tubes in the set of first heat exchange tubes, middle parts between two ends of the at least multiple second heat exchange tubes in the set of second heat exchange tubes, and the at least multiple fins in the set of fins are arranged in a same row in the arrangement direction.

6. The dual circuit air-conditioning system as claimed in claim 5, wherein:

the at least multiple first heat exchange tubes in the set of first heat exchange tubes, the at least multiple second heat exchange tubes in the set of second heat exchange tubes and the at least multiple fins in the set of fins are arranged in an arrangement direction such that:

the at least multiple first heat exchange tubes are respectively arranged at (M1)th positions, M1=4n−3;

the at least multiple second heat exchange tubes are respectively arranged at (M2)th positions, M2=4n−1; and the at least multiple fins are respectively arranged at Nth positions, N=2n, where n is a positive integer.

* * * * *